US012560067B2

(12) United States Patent
Alekseev et al.

(10) Patent No.: US 12,560,067 B2
(45) Date of Patent: Feb. 24, 2026

(54) METHOD FOR HYDRAULIC FRACTURING AND MITIGATING PROPPANT FLOWBACK

(71) Applicant: SCHLUMBERGER TECHNOLOGY CORPORATION, Sugar Land, TX (US)

(72) Inventors: Alexey Vladimirovich Alekseev, Novosibirsk (RU); Dimitry Arefievich Chuprakov, Moscow (RU); Denis Viktorovich Bannikov, Novosibirsk (RU); Dmitry Sergeevich Kuznetsov, Novosibirsk (RU); Ludmila Sergeevna Belyakova, Novosibirsk (RU); Denis Evgenievich Syresin, Moscow (RU); Pavel Evgenievich Spesivtsev, Moscow (RU); Aliya Rafailovna Yuldasheva, Moscow (RU); Ivan Vladimirovich Velikanov, Novosibirsk (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 976 days.

(21) Appl. No.: 17/755,239

(22) PCT Filed: Oct. 31, 2019

(86) PCT No.: PCT/RU2019/000778
§ 371 (c)(1),
(2) Date: Apr. 25, 2022

(87) PCT Pub. No.: WO2021/086220
PCT Pub. Date: May 6, 2021

(65) Prior Publication Data

US 2022/0364454 A1 Nov. 17, 2022

(51) Int. Cl.
*E21B 43/267* (2006.01)

(52) U.S. Cl.
CPC ..... *E21B 43/267* (2013.01); *E21B 2200/20* (2020.05)

(58) Field of Classification Search
CPC .... E21B 43/267; E21B 41/00; E21B 2200/20; G06F 30/25; G06F 30/28; G06F 2111/10
See application file for complete search history.

(56) References Cited

U.S. PATENT DOCUMENTS 10,544,667 B2 1/2020 Wu et al.
10,941,642 B2 * 3/2021 Gu ..... E21B 43/267
(Continued)

FOREIGN PATENT DOCUMENTS

CN 108104788 A 6/2018

OTHER PUBLICATIONS

Andrews, J.S. & Kjørholt, H. "Rock mechanical principles help to predict proppant flowback from hydraulic fractures" Society of Petroleum Engineers, SPE/ISRM 47382 (1998) (Year: 1998).*
(Continued)

*Primary Examiner* — Jay Hann
(74) *Attorney, Agent, or Firm* — Jeffrey D. Frantz

(57) ABSTRACT

Design method for hydraulic fracturing of a reservoir is presented that maximize well production rates and minimize proppant flowback. The method comprises employing computer simulators that analyze a fracturing treatment design in the context of well properties, reservoir properties, fluids and proppants, and calculates a critical filtration velocity for a proppant pack. If the fluid flow velocity in the fracture exceeds the critical filtration velocity, there is a risk for proppant flowback. The method is applicable to wells that have not yet been fractured, as well as those that have previously undergone a fracturing treatment.

12 Claims, 12 Drawing Sheets

(56) References Cited

U.S. PATENT DOCUMENTS

| | | | | |
|---|---|---|---|---|
| 2012/0318500 | A1 | 12/2012 | Urbancic | |
| 2014/0305638 | A1 | 10/2014 | Kresse | |
| 2016/0251948 | A1 | 9/2016 | Weng et al. | |
| 2016/0341850 | A1 | 11/2016 | Lin et al. | |
| 2017/0075001 | A1 | 3/2017 | McColpin | |
| 2017/0075006 | A1 | 3/2017 | Dusterhoft et al. | |
| 2017/0123089 | A1 | 5/2017 | Walters | |
| 2017/0145793 | A1 | 5/2017 | Quenes | |
| 2018/0016895 | A1* | 1/2018 | Weng | G01V 1/306 |
| 2018/0016897 | A1 | 1/2018 | Willberg et al. | |
| 2020/0072026 | A1* | 3/2020 | Ray | E21B 43/267 |

OTHER PUBLICATIONS

Batenburg, D., et al. "Towards Proppant Back-Production Prediction" Society of Petroleum Engineers, SPE 54730 (1999) (Year: 1999).*

Smith, M.B., et al. "Enhanced 2D Proppant-Transport Simulation: The Key To Understanding Proppant Flowback and Post-Frac Productivity" Society of Petroleum Engineers, SPE 69211 (2001) (Year: 2001).*

Tsai, K., et al. "Advanced Computational Modeling of Proppant Settling in Water Fractures for Shale Gas Production" Society of Petroleum Engineers, SPE 151607 (2012) (Year: 2012).*

Milton-Tayler D et al., "Factors Affecting the Stability of Proppant in Propped Fractures: Results of a Laboratory Study", Society of Petroleum Engineers, paper SPE 24821 (1992), pp. 569-579.

Asgian MI et al., "The Mechanical Stability of Propped Hydraulic Fractures: A Numerical Study", Journal of Petroleum Technology, paper SPE 28510-PA (Mar. 1995), pp. 203-208.

Canon et al., "Avoiding Proppant Flowback in Tight-Gas Completions with Improved Fracture Design", Society of Petroleum Engineers, paper SPE 84310 (2003), 11 pages.

Search Report of International Patent Application No. PCT/RU2019/000778 mailed Jul. 23, 2020; 2 pages.

Written Opinion of International Patent Application No. PCT/RU2019/000778 mailed Jul. 23, 2020; 4 pages.

Shor and Sharma, "Reducing Proppant Flowback From Fractures: Factors Affecting the Maximum Flowback Rate", Society of Petroleum Engineers, paper SPE 168649 (2014), 11 pages.

Fan et al., "Interaction between Proppant Packing, Reservoir Depletion, and Fluid Flow in Hydraulic Fractures", Offshore Technology Conference, paper OTC-27907-MS (2017), 19 pages.

Vernigora D et al., "Unveil the Unknown: Combining the Laboratory Study of Fracturing Fluids at High Pressure with a State-of-the-Art Hydraulic Fracturing Simulator", Society of Petroleum Engineers, paper SPE-189518 (2018), 22 pages.

Velikanov et al., "New Fracture Hydrodynamics and In-situ Kinetics Model Supports Comprehensive Hydraulic Fracture Simulation", Society of Petroleum Engineers, paper SPE-190760 (2018), 21 pages.

Pankaj et al., "Back to Basics: Revisiting Proppant and Fluid Selection for Unconventional Reservoirs Using a New 2D Slurry Transport Model", Society of Petroleum, paper SPE-191422 (2018), 21 pages.

Aidagulov GR et al., "Prediction of Long-Term Proppant Flowback in Weak Rocks," Society of Petroleum Engineers, paper SPE 106264-MS (2007), 10 pages.

International Preliminary Report on Patentability issued in PCT Application PCT/RU2019/000778 dated May 12, 2022, 6 pages.

Office Action issued in Argentina Patent Application No. P200103007 dated Aug. 18, 2024 8 pages.

* cited by examiner

METHOD FOR HYDRAULIC FRACTURING AND MITIGATING PROPPANT FLOWBACK

CROSS REFERENCE TO RELATED APPLICATION(S)

This application is a National Stage entry of International Patent Application No. PCT/RU2019/000778, filed on Oct. 31, 2019.

TECHNICAL FIELD

The present disclosure relates generally to hydraulic fracturing operations. In particular, the disclosure relates to performing computer simulations of hydraulic fracturing operations, with the goal of minimizing flowback of proppant from the fracture into the wellbore during fracture clean-up and production.

BACKGROUND

Hydraulic fracturing is a widely used well stimulation technique aiming at creation of highly conductive path in a reservoir rock. Large volumes of fluid containing proppant particles are injected into the created fracture. A common problem after a propped fracturing stimulation is proppant back-production during flowback (also known as proppant flowback). Proppant flowback typically occurs instantly during well cleanup or over a period of several days to weeks after the fracturing treatment, but it can also begin anytime during the economic life of the well. Proppant flowback often leads to significant losses of fracture conductivity due to fracture closure in a proppant-free near wellbore zone. This may compromise economic production rates from the entire well. It also may have a detrimental effect on production equipment due to plugging or erosion of surface and downhole completions, and lead to loss of revenue during downtime when equipment is replaced. In addition, produced proppant must be separated from the produced hydrocarbons adding further processing expense. The net impact of proppant flowback can result in the reduced production, damaged equipment, downtime and ultimately loss of revenue.

Several means have been attempted in order to limit or eliminate flowback of particulate proppant materials placed into the formation during a fracturing treatment. One means showing reasonable effectiveness has been to gradually release fracturing pressure once the fracturing operation has been completed so that fracture closure pressure acting against the proppant builds gradually, allowing the proppant matrix to stabilize before fracturing fluid flowback and well production can carry significant quantities of the proppant out of the fractures and back to the wellbore. It has also been common to use "resin-coated proppant (RCP)", that is, particulate proppant materials having an adherent coating bonded to its outer surface so that the proppant particles are bonded to each other, a process which further reduces the possibility of proppant flowback. Inspite of RCP ability to prevent proppant flow back, it has several disadvantages: lower conductivity, compared to non-coated proppants, thus may create lower-conductive zone in near-wellbore region. RCP may have compatibility issues with fracturing fluids, and importantly, it has temperature limitations: limited applicability in low-temperature formation. Another common industry practice in to use different fibers as a PFB prevention measure, which may decrease near wellbore conductivity as well, and also has operational complexity issues.

Thus, existing methods for commencing well production, as well as the application of various proppant flowback prevention additives have some limitations and do not guarantee that proppant will not appear at the surface in a week, in a month or even in a year. Shut-in periods, gas slugging, proppant crushing, and other abnormalities during the well life-time may lead to noticeable changes in fluid rate, fracture width and stress on proppant, eventually resulting in proppant flowback. In turn, it raises the question of a long-term fracture conductivity forecast. Solving this problem is difficult without a fundamental understanding of the proppant flowback phenomenon and the ability to model the processes that occur downhole at any moment in time. The presence of such a model would allow choosing the best operation scenario for the particular well.

In this invention, we define design of fracturing treatment or flowback as the selection of specific operational parameters for fracturing or flowback job, respectively, e.g. pumping rate, proppant concentrations, total injection volume, bottomhole pressure drawdown, wellhead choke opening schedule. The modeling is defined here as the computer simulation of fracturing or flowback physical process, respectively, associated with the fluid and proppant flow inside fractures.

SUMMARY

Figure 1:
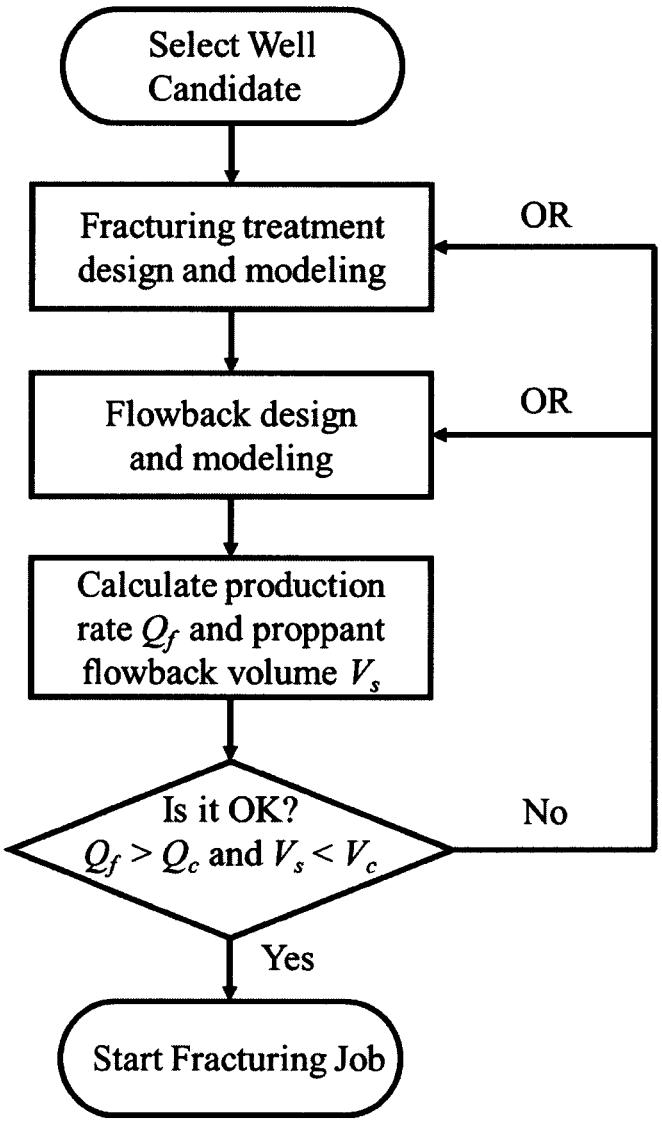
FIG. 1 is a flowchart showing a sequence of events for preventing proppant flowback. This flowchart depicts Workflow 1 which includes both fracturing treatment design and flowback design based on proppant flowback modeling.

In an aspect, embodiments relate to methods for fracturing a subterranean well and mitigating proppant flowback. The goal of workflow (modeling and adjusting of design parameters) is achieving two satisfactory parameters describing the amount of proppant flowback and the fluid production volume for a certain period. (i) A fracturing treatment is designed for stimulating a reservoir wherein a fracture will be created. Design parameters include proppant concentration, fluid viscosity, flow rate, job stages and final fracture geometry, and combinations thereof. (ii) A computer simulation of the fracturing treatment is performed, generating a prediction of fracture propagation, proppant distribution, fluid distribution and fracture conductivity distribution. (iii) Flowback design parameters are set. Such flowback design parameters comprise bottomhole or wellhead pressure, flowback time and flowback duration. The computer simulation divides the final fracture geometry into individual cells. (iv) A critical filtration velocity $u_c$ is determined for each computation cell for a final fracture geometry. (v) Next, for specified flowback conditions, a fluid production flow rate and associated proppant flowback volume are determined. (vi) A recovered proppant volume $V_s$ and a fluid production $Q_f$ at a near-wellbore boundary are computed by repeating the determination of the critical filtration velocity and associated fluid production flow rate and proppant flowback volume for consecutive intervals of flowback duration. (vii) If $V_s<V_c$ and $Q_f>Q_{min}$, a fracturing treatment and flowback job are performed as designed. $Q_{min}$ is a minimum acceptable fluid production rate and $V_c$ is a maximum acceptable proppant flowback volume. (viii) If $V_s$ or $Q_f$ do not satisfy the conditions stated above, steps (i)-(vi) are repeated with adjusted fracturing and/or flowback design parameters.

In another aspect, embodiments relate to methods for fracturing a subterranean well. (i) A design is obtained for a previously performed fracturing treatment for stimulating a reservoir. (ii) A computer simulation of the fracturing treatment is performed, generating a prediction of fracture propagation, proppant distribution, fluid distribution and fracture conductivity distribution. (iii) Flowback design parameters are set. Such flowback design parameters comprise bottomhole or wellhead pressure, flowback time and flowback duration. The computer simulation divides the final fracture geometry into individual cells. (iv) A critical filtration velocity $u_c$ is determined for each computation cell for a final fracture geometry. (v) Next, for specified flowback conditions, a fluid production flow rate and associated proppant flowback volume are determined. (vi) A recovered proppant volume $V_s$ and a fluid production $Q_f$ at a near-wellbore boundary are computed by repeating the determination of the critical filtration velocity and associated fluid production flow rate and proppant flowback volume for consecutive intervals of flowback duration. (vii) If $V_s<V_c$ and $Q_f>Q_{min}$, a satisfactory flowback design is found. Flowback job is performed as designed. $Q_{min}$ is a minimum acceptable fluid production rate and $V_c$ is a maximum acceptable proppant flowback volume. (viii) If $V_s$ or $Q_f$ do not satisfy the conditions stated above, steps (iii)-(vi) are repeated with adjusted flowback design parameters.

DETAILED DESCRIPTION

At the outset, it should be noted that in the development of any such actual embodiment, numerous implementations—specific decisions must be made to achieve the developer's specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. Also, in the summary of the disclosure and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific points, it is to be understood that inventors appreciate and understand that any and all data points within the range are to be considered to have been specified, and that inventors possessed knowledge of the entire range and all points within the range.

This disclosure presents new methods for fracturing job design and well production that maximize well productivity and minimize the risk of proppant flowback.

The methods present a criterion that allows operators to define the risk of proppant flowback under given conditions. This criterion is based on a new mathematical model that allows calculating the minimum fluid filtration velocity (aka critical filtration velocity, $u_c$) that triggers proppant flowback for a given proppant size, closure stress, fracture width, and fluid viscosity. Proppant flowback may occur if the fluid filtration velocity, which can be derived from the production rate, is above its critical value. Otherwise, the proppant pack is stable. This criterion can be applied in any flow simulator that considers coupled flow of fluids and proppants.

The methods also present workflows that utilize the proposed criterion for optimization of fracturing job design, as well as determining the optimal well production strategy.

The methods allow operators to maximize the efficiency of the fracturing treatment, maximize well productivity, and minimize non-productive time and workover expenses arising from proppant flowback.

Patent application US 2018/0016897A1 describes using transient fluid flow simulations to predict the phase composition of production fluid, and controlling fluid flow through wellhead orifices.

Patent application US 2016/0341850A1 present a discrete fracture network (DFN) model representing a fracture network in a subterranean region, and integrates several submodels—including a flow-back/leak-off model (1D, 2D, 3D). This model describes proppant flowback volume during a fracturing treatment, but does not describe the proppant flowback (solid immobilization) in a closed fracture during well production.

Milton-Tayler D et al.: "Factors Affecting the Stability of Proppant in Propped Fractures: Results of a Laboratory Study, paper SPE 24821 (1992). This paper presents experiments that determined factors controlling the stability of proppant in propped fractures. The absolute size, distribution and type of proppant may affect the stability of packing, and, hence, the likelihood of proppant flowback.

Asgian M I et al.: "The Mechanical Stability of Propped Hydraulic Fractures: A Numerical Study," paper SPE 28510-PA (1995). This paper demonstrates how various properties and conditions (e.g., closure stress, fracture width, proppant embedment in the fracture walls, grain-size distribution, relative inclination of the fracture walls, and drawdown) affect the mechanical stability of cohesionless, unbonded proppant packs. The numerical simulations show that hydraulic fractures propped with unbonded proppant fail under closure stress at a critical ratio of mean grain diameter to fracture width.

Aidagulov G R et al.: "Prediction of Long-Term Proppant Flowback in Weak Rocks," paper SPE 106264-M S (2007). This paper presents a modeling approach for predicting the quantity of proppant flowback. The model accounts for limited number of physical effects via numerical calculation.

Shor R J: "Reducing Proppant Flowback From Fractures: Factors Affecting the Maximum Flowback Rate," paper SPE 168649 (2014). A model was developed using a discrete element method (DEM) particle simulator to simulate cubic volumes consisting of fracture openings, fracture walls and the confining formation. The effects of fracture width, confining stress, fluid flow velocity and proppant cohesion were studied. Fracture width was found to be dependent on confining stress and fluid flow velocity, while proppant back-production was also dependent on cohesion.

Vernigora D et al.: "Unveil the Unknown: Combining the Laboratory Study of Fracturing Fluids at High Pressure with a State-of-the-Art Hydraulic Fracturing Simulator," paper SPE 189518-M S (2018). This paper describes simulating fluid-and-proppant flowback volume with Kinetix® software (trademark of Schlumberger) during the fracturing stage, before the flow-back stage.

As described earlier, methods are disclosed for fracturing job design and/or initial well production management that minimizes the risk of proppant flowback from the created hydraulic fractures, while maintaining a satisfactory fluid production rate. The methods comprise the following.

1. A model of critical (minimum) filtration velocity that triggers proppant flowback. The model uses parameters of the hydraulic fracture and proppants to estimate the regions where solid mobilization occurs. The model uses two simulators.

- A fracturing treatment simulator predicts the spatial distribution of injected proppants across the entire surface of a created hydraulic fracture. The simulator considers the reservoir conditions and a selected pumping schedule.
- A flowback simulator describes the backflow of the injected fluids and solids (proppant) from a fracture to a wellbore, resulting from the pressure drawdown after the fracturing treatment. The amount and rate of produced proppant is the particular result of this simulation, which depends on the correct model for proppant flowback.

2. Model-based workflows for preventing proppant flowback to the wellbore, comprising:

- fracturing treatment design; and
- flowback computer simulation, applying the model for critical filtration velocity, $u_c$.

Two workflows are envisioned. Workflow 1 is applicable for the wells prior to their fracturing treatment. Workflow 2 is applicable for the wells with a previously performed fracturing treatment.

Critical Filtration Velocity Model

A model was developed for predicting proppant mobilization in a fracture under high confining stress. The model determines the minimum filtration velocity that triggers proppant, hereafter referred to as the critical filtration velocity model. The model is based on the concept of proppant pack erosion from the proppant pack edge, where confining stresses are several orders lower than those in the central part of the proppant pack. The critical filtration velocity for proppant mobilization depends on the ratio of fracture width (w[m]) to the mean proppant particle diameter (d[m]), the type of the proppant, and filtrating fluid viscosity ($\mu_f$[Pa·s]). It also takes into account the bridging effect (b), which depends on the proppant particle embedment into the fracture walls, which is also a function of closure stress ($\sigma_n$[Pa]).

The critical filtration velocity in a cell with proppant, where mobilization of proppant occurs at a speed exceeding this value, is given below.

$$u_c = \frac{A}{u_f d}\left(\frac{w}{d} - b(\sigma_n)\right)^{-1}, \tag{1}$$

where A [Pa·m$^2$] is a fitting coefficient, and $b(\sigma_n)$ is a logarithmic function of stress:

$$b(\sigma_n)=b_1+b_2 \ln(\sigma_n[Pa]), \tag{2}$$

where $b_1$ is a fitting coefficient related to proppant bridging, and $b_2$ is a fitting coefficient related to proppant embedment, strongly dependent on closure stress. Fitting coefficients were determined from a series of laboratory experiments on confined proppant flowback at different filtration rates and for different proppants.

This model above is universal and can be applied not only to near-spherical proppants, but also to rod-shape proppants. For example, for cylindrical proppants, the critical filtration velocity can be described by the same equation, using a diameter of a volume-equivalent sphere that is equivalent to a cylinder.

$$d_{vol} = \sqrt[3]{1.5 \cdot L \cdot D^2} \tag{3}$$

where L is an average length of a cylindrical particle, and D is an average diameter of the particles.

Workflows

The disclosed methods for proppant flowback prevention during flowback and production offer two variants: (1) by controlling both the hydraulic fracture treatment and the flowback job design, and (2) by controlling only the flowback job design. Workflow 1 is applicable for the wells prior to their fracturing treatment. Workflow 2 is applicable for wells that have previously undergone a fracturing treatment.

Workflow 1

FIG. 1 is a flowchart that illustrates a workflow for fracturing job design, with the aim of overcoming proppant flowback issues by applying the model for critical filtration velocity. Application of this workflow eliminates a root cause of proppant flowback—inferior job design. In this case, the model can indicate if the design increases the risk of proppant flowback and, to avoid this, requiring a treatment redesign to achieve better economical results (e.g., efficient utilization of pump horsepower, stable production rate and longer well productivity).

Step 1. A well candidate is selected, as defined by business considerations.

Step 2. Designing the hydraulic fracturing treatment includes the following steps:

- obtaining the mechanical and conductive properties of the reservoir, based on log data and other measuring tools;
- collecting information concerning the well—trajectory, the completion (e.g., placement of casing string perforations);
- collecting laboratory data concerning the properties of hydraulic fracturing materials—the fluids (rheological parameters and density), the proppant (size, type, and density), fibers (if present, for example the impact on the proppant settling rate);
- selecting the hydraulic fracturing injection schedule—selection of the injection material (viscous fluids, proppant and additives), flow rate, volume of injected hydraulic fracturing materials, proppant concentration, fiber and additives concentrations and maximum pressure during hydraulic fracturing;
- simulating the hydraulic fracturing operation—simulating of fracture propagation and the transport of hydraulic fracturing materials therein, and calculating the fracture conductivity distribution; and
- considering the simulator results at the time of completion of the hydraulic fracturing schedule (local proppant concentration, concentration of residual gel, distribution of conductivity for the propped fracture).

Step 3. Next, a proppant flowback simulation is performed. This includes the following steps.

Figure 2:
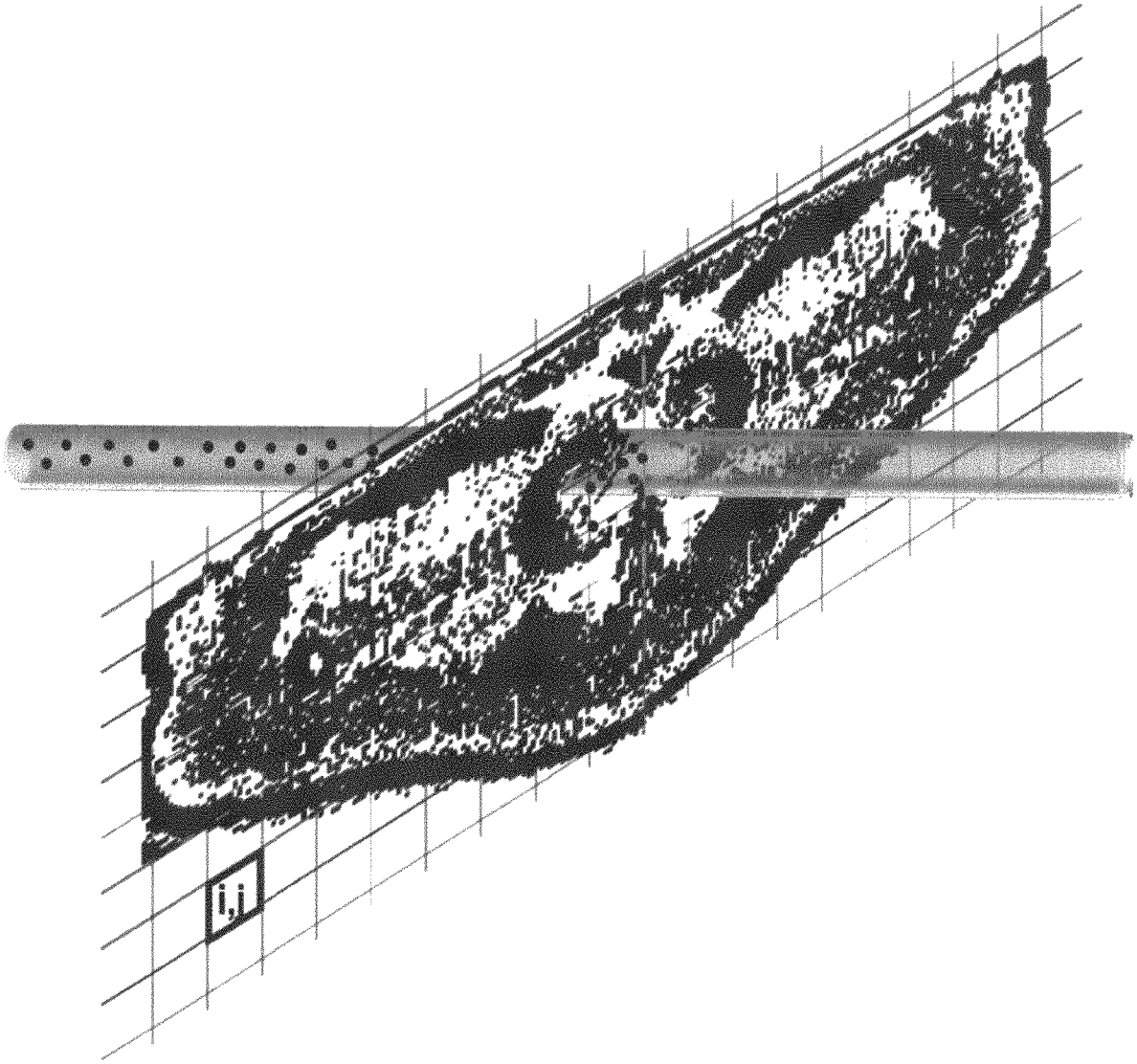
FIG. 2 is a graphic representation of a fracture that is producing proppant during flowback. The black regions depict proppant in the fracture.

- The hydraulic fracture geometry, as simulated earlier according to the fracture design, provides the predicted distribution of proppant concentration inside a fracture, as well as fluid pressure and stresses in the rock. The geometry and grid of a simulated hydraulic fracture is shown in FIG. 2. Each region between the grid lines represents a "cell."
- A wellbore pressure is prescribed, which can for example arise from opening a wellhead choke.
- Fluid and solids flow inside the fracture is modeled by considering the rheological properties of the suspension.
- Proppant mobilization in the fracture under confining stress is modeled by using a model of solid-and-fluid flow in the backward direction. The critical filtration velocity $u_c$ is an essential parameter of this software and being calculated at each computational cell (i, j) as shown in FIG. 2. The $u_c$ at a particular cell is compared with those at corresponding cells. If the filtration velocity in a particular cell exceeds $u_c$, this means that proppant is movable from this cell. If not, the proppant is stable.
- The proppant flowback simulation data are considered at the time of completion of the proppant flowback schedule (proppant and fluids production, proppant distribution, fracture width and porosity).

Step 4. Next, the total amount of proppant flowback into the wellbore is evaluated, as well as the total fluid production rate. The total amount of produced proppant $V_s$ [$m^3$] is a sum of the rates of proppant flow in each computational cell adjacent to the perforations (connecting the fracture to the well) at a simulation time $\Delta t$ [s]

$$V_s=\Sigma_{(i,j)\in perf} v_s^{ij} w^{ij}(1-\varphi^{ij})\Delta l^{ij}\Delta t, \quad (4)$$

Where $v_s^{ij}$ [m/s] is the solid (proppant) velocity in (i,j) cell, $w^{ij}$ [m] is the local fracture width and $\varphi^{ij}$ [dimensionless] is the porosity of the cell, and $\Delta l^{ij}$ [m] is the size of the cell. The goal of the disclosed method is to minimize this value. The critical amount of proppant flowback $V_c$ [$m^3$], above which is unacceptable, is defined by the field operation personnel or business considerations. Therefore, $$V_s<V_c. \quad (5)$$

Due to proppant flowback, the total fluid production rate $Q_f$ [$m^3$/s] from the fracture can be changed, which can be inferred by the modeling. Therefore, $Q_f$ should be higher than a minimum production rate, $Q_{min}$ [$m^3$/s], which is also defined by field operation personnel or business considerations.

$$Q_f>Q_{min}. \quad (6)$$

Calculation of the fluid production rate $Q_f$ is similar to that described above for the solids production. Thus, the sum of the rates of fluid flow in each computation cell adjacent to the perforations is also determined.

$$Q_f=\Sigma_{(i,j)\in perf} u_f^{ij} w^{ij}\Delta l^{ij}, \quad (7)$$

where $u_f^{ij}$ [m/s] is the filtration fluid velocity in the (i,j) cell.

Step 5. If the total proppant produced $V_s$ exceeds acceptable limit $V_c$, or fluid production rate $Q_f$ is less than the minimum admissible value $Q_{min}$, the method directs the operator back to Step 2 or Step 3, where either the fracturing treatment design or the flowback design is changed. This process is iterative until the criterion of Step 5 is satisfied.

Step 6. Otherwise, if the total proppant produced $V_s$ is less than $V_c$, and fluid production rate $Q_f$ exceeds $Q_{min}$, the suggested designs for fracturing treatment and flowback are suitable for application in the field.

Workflow 2

Figure 3:
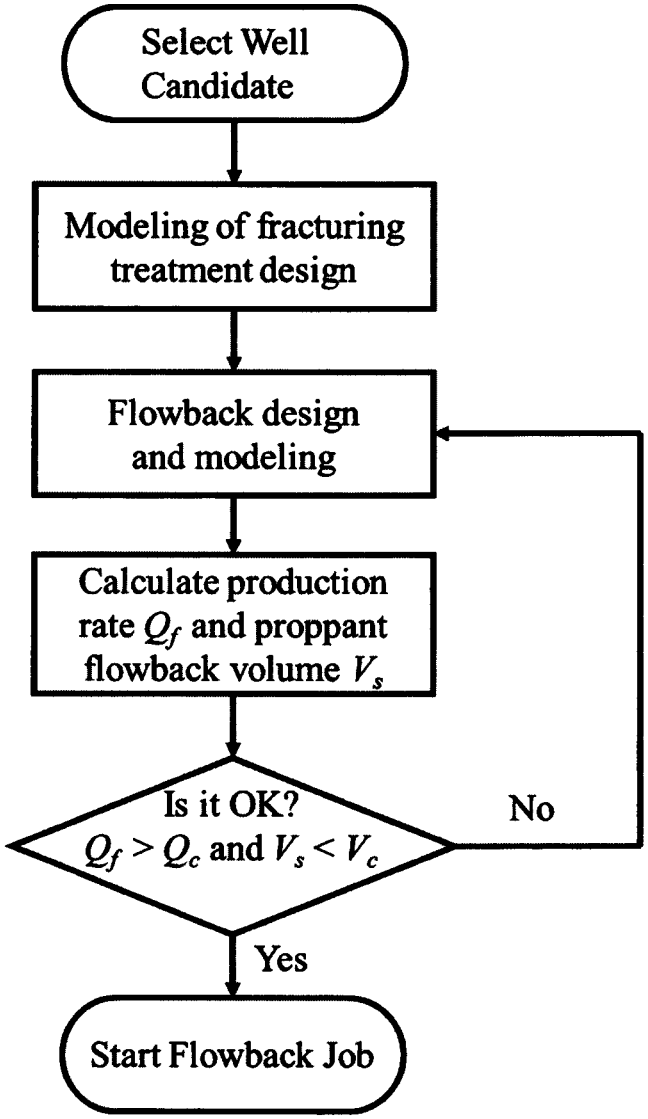
FIG. 3 is a flowchart showing a sequence of events for preventing proppant flowback. This flowchart depicts Workflow 2 which pertains to wells that have already undergone a fracturing treatment. Therefore, only flowback design based on proppant flowback modeling is performed.

FIG. 3 presents another method for proppant flowback mitigation. This method pertains to wells that have already undergone a fracturing treatment. This workflow can be applied to minimize the damage when the fracturing job has been already performed and the job design is not optimal (for example, predicted proppant flowback volume is higher than $V_c$) for the particular well. In this case the model can suggest a fluid production rate that minimizes proppant flowback and avoids pinching of the near wellbore zone.

The procedure is similar to Workflow 1, except for Step 5. Since the fracturing treatment has already taken place, if the fluid production rate $Q_f$ and/or proppant flowback $V_s$ are unsatisfactory, the method directs the operator back to Step 3 only. The flowback schedule is adjusted to mitigate the risk of proppant flowback while maintaining a satisfactory production rate.

EXAMPLES

The following example serves to further illustrate the disclosure.

Example 1

Proppant Flowback Mitigation by Changing the Fracturing Treatment Design

Synthetic data have been used to illustrate how the difference in critical filtration velocity $u_c$ distribution in fractures impacts the volume of proppant mobilized from the fracture during flowback. As an example, two synthetic fractures are considered (Fracture 1 and Fracture 2) with different designs, created in the same reservoir and under the same pressure conditions. Both fractures contain the same single-component incompressible fluid with density 1 g/cc and a viscosity of 1 cP and the same proppant with the following properties: Proppant Density: 3.24 g/cm$^3$; Proppant Grain Diameter: 1.05 mm; Proppant Pack Density: 0.39

Figure 4A:
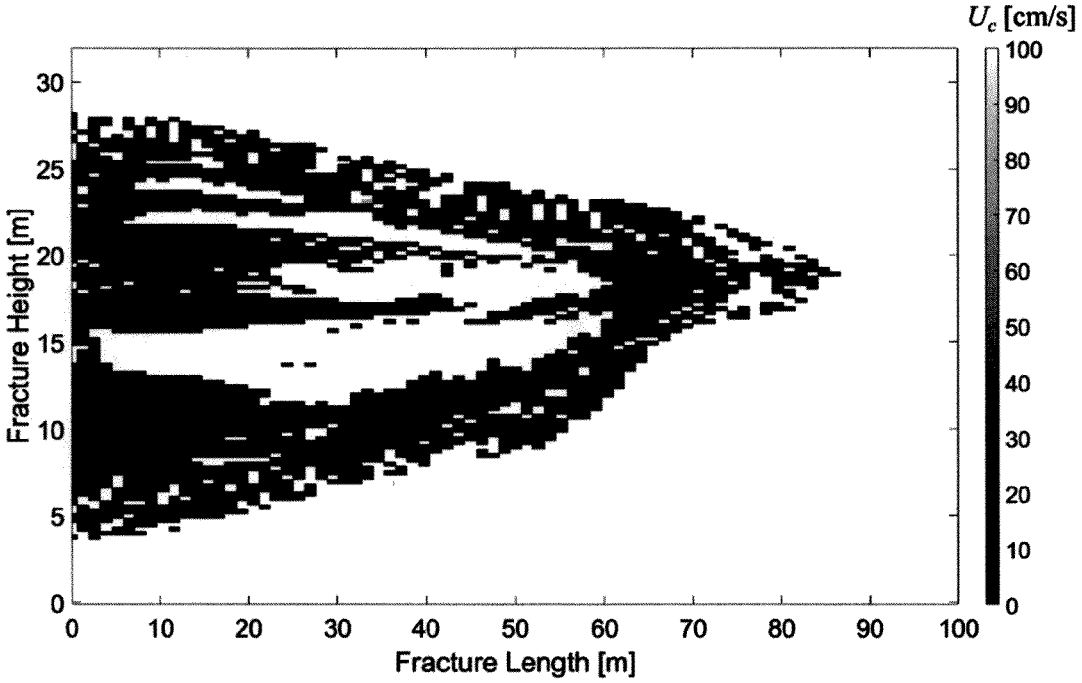
FIG. 4*a* shows a distribution of critical filtration velocities, $u_c$, at the beginning of flowback in "Fracture 1.
Figure 4B:
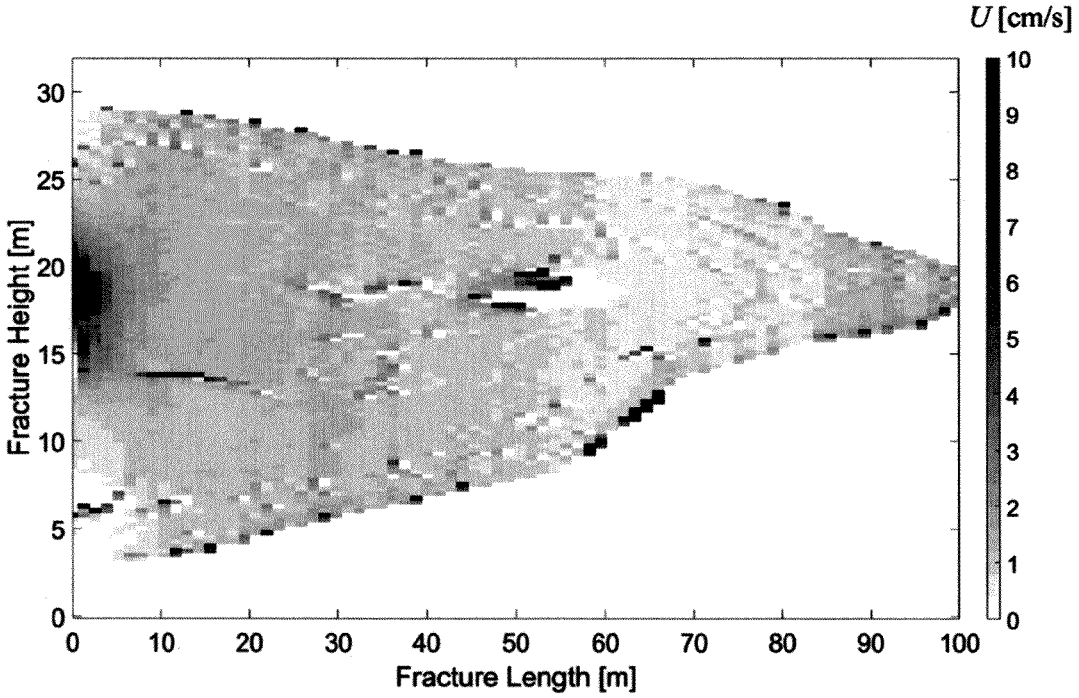
" FIG. 4*b* shows the fluid velocity field at the beginning of flowback in "Fracture 1."
Figure 5A:
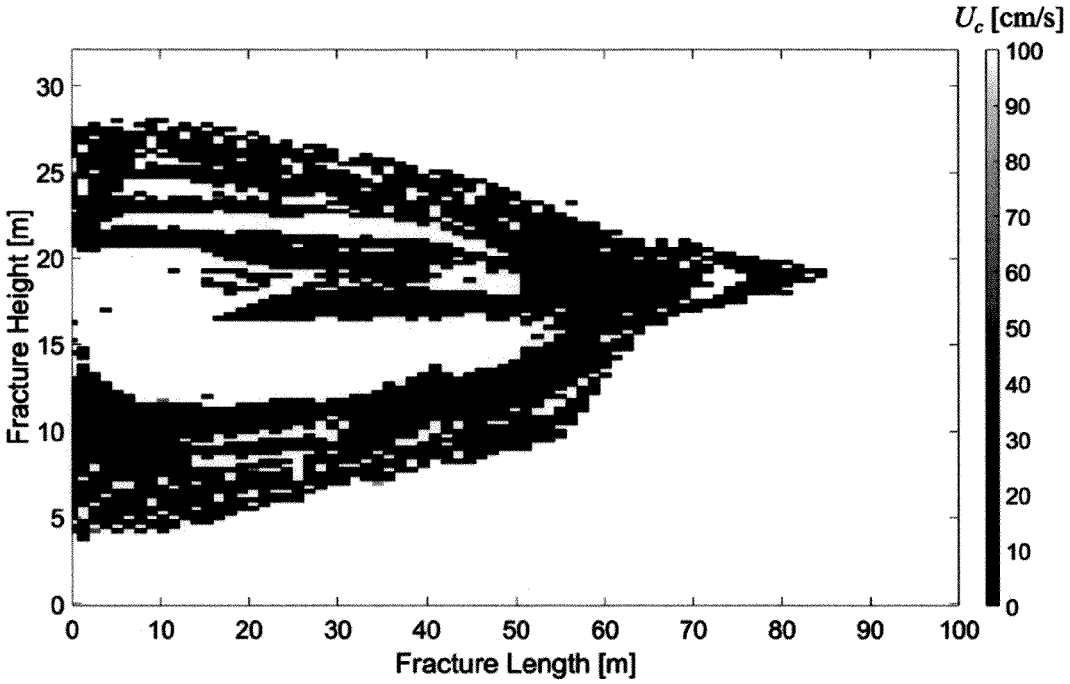
FIG. 5*a* shows a distribution of critical filtration velocities, $u_c$, at the beginning of flowback in "Fracture 2.
Figure 5B:
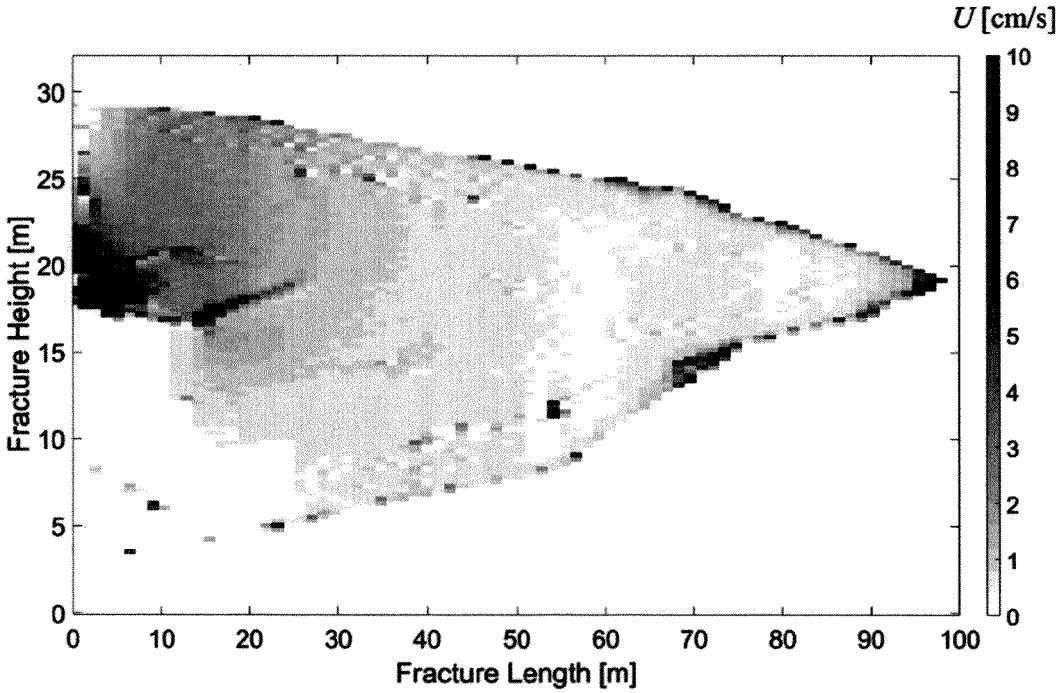
" FIG. 5*b* shows the fluid velocity field at the beginning of flowback in "Fracture 2."

All of the simulations for fracture geometry and proppant distribution were performed by the Kinetix® hydraulic fracture simulator (trademark of Schlumberger). The "Fracture 1" was created with a commonly used pumping schedule during the fracturing job and it may be considered to be a reference. To modify this design into "Fracture 2," the gel viscosity and the maximum proppant concentration were decreased, resulting in a smaller fracture aperture near the perforation zone. The "Fracture 2" design may be considered to be optimized. Both simulated fractures have different proppant mobilization abilities, as illustrated by distributions of the critical filtration velocity $u_c$, calculated by Eq. 1. FIG. 4*a* shows proppant $u_c$ distribution computed for the reference design ("Fracture 1") and FIG. 5*a* provides the similar $u_c$ distribution for the optimized design ('Fracture 2"). The white color in the colormaps of FIGS. 4*a* and 5*a* correspond to computational cells with higher $u_c$ values, and the shadowed areas correspond to computational cells with lower $u_c$ values. As has been explained earlier, proppant in regions where the filtration velocity is below $u_c$ will be stable and immobile—only fluid motion will be enabled. Therefore, the white cells correspond to regions where the proppant is stable and the black cells correspond to regions where the proppant is mobile. For reasons of simplicity, FIGS. 4*a* and 5*a* do not show the fluid velocity field during the production stage. The fluid velocity field during the production stage is presented in FIGS. 4*b* and 5*b*. The darker regions correspond to areas with higher fluid velocities.

In Fracture 1, there is a high risk of proppant flowback. The $u_c$ in the vicinity of the perforation is below 5 cm/s. In Fracture 2, there is a lower risk of proppant flowback. The $u_c$ in the vicinity of the perforation is about 50 cm/s. The lower risk in Fracture 2 may be explained by the smaller fracture aperture at the perforation zone. Because the most transient flows typically occur near the perforation zone, the higher $u_c$ values at Fracture 2 provide the higher proppant pack stability.

Figure 6:
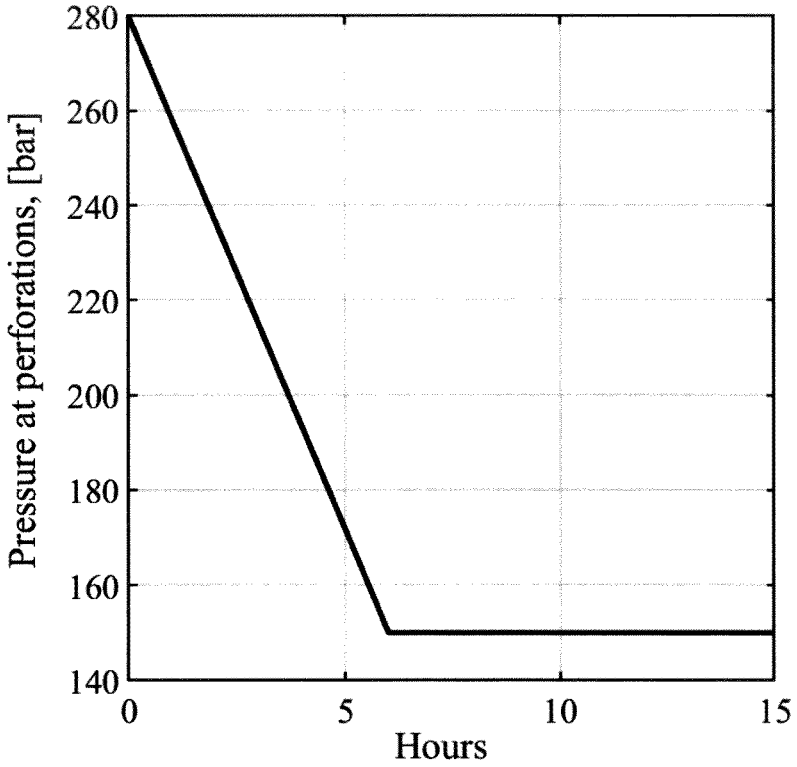
FIG. 6 shows a pressure at a fracture perforation for flowback modeling.

To initiate the flowback, a pressure drop is initiated at the fracture's perforation zone with the pressure temporal dependence shown in FIG. 6 (only first 15 hours shown). The same pressure drop was applied to both Fractures 1 and 2 to perform the flowback simulations. The simulations cover 20 days of flowback, wherein during the first 6 hours, the pressure at the perforation linearly decreased from the reservoir pressure of 280 bar to 150 bar, and then remained constant until the end of the simulation.

Figure 7:
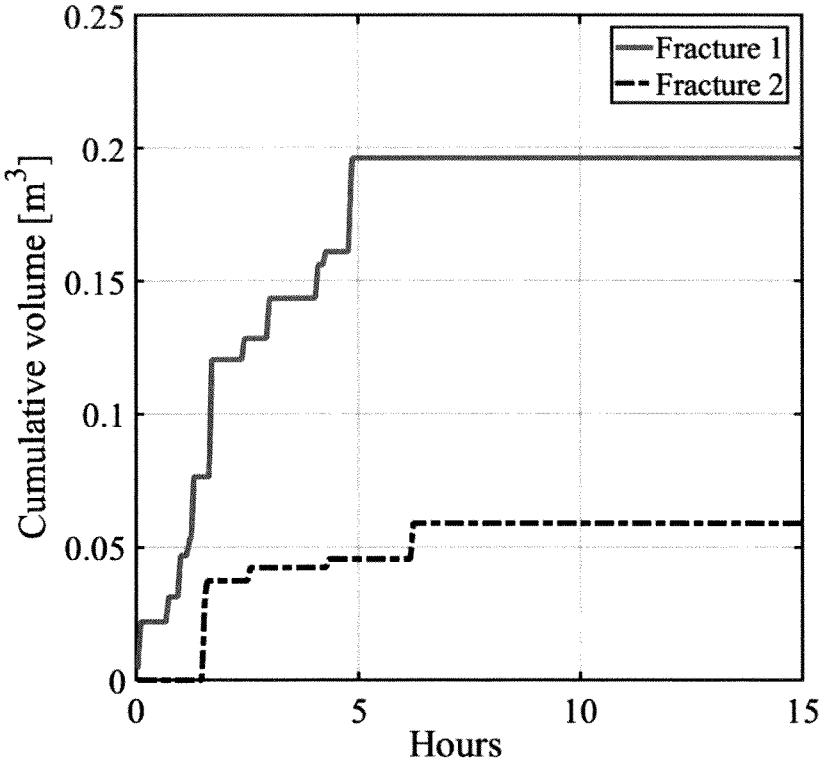
FIG. 7 shows a comparison of cumulative proppant flowback for two simulated fracture scenarios.

FIG. 7 shows the comparison of total volume of proppant flowed out of fracture for Fracture 1 (solid curve) and Fracture 2 (dashed line). After 10 hours, the proppant flowback stopped in both fractures. As the result, one can see four times difference in cumulative produced proppant volume between Fracture 1 and Fracture 2. It indicates the higher proppant pack stability in Fracture 2, and thus a better fracture design.

Figure 8:
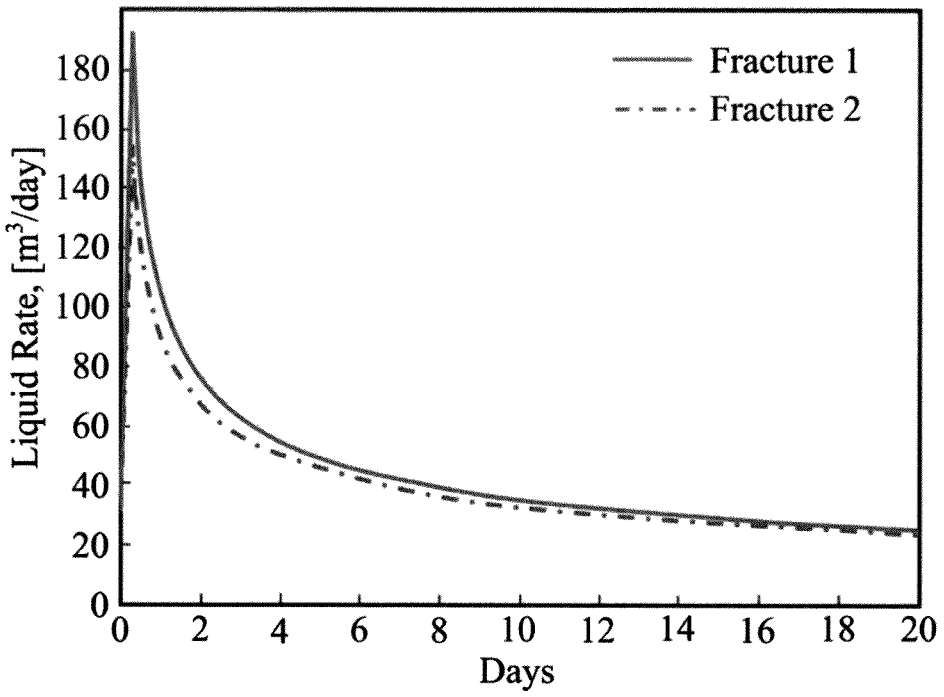
FIG. 8 shows liquid production rates for two simulated fracture scenarios.

FIG. 8 shows the instantaneous liquid production rates during the first 20 days of production. The Fracture 1 design provides higher production rates at the beginning of flowback, however, the simulation does not show a significant difference between the Fracture 1 (solid line) and Fracture 2 (dashed line) treatment at longer times, which is a potentially acceptable scenario for production planning.

It is noteworthy that this example shows only one iteration in the fracturing job design workflow (see FIG. 1). However, for real applications, the number of such iterations can be as high as needed to achieve the desired improvement of the fracture design.

Example 2

Optimization of Fracturing Treatment Design for Mitigation of Proppant Flowback and Improvement of Well Productivity This example shows how may adjust the proppant placement schedule during a fracturing treatment design with the goal of optimizing the production rate and reducing proppant flowback. In a base case, the fracturing treatment has been designed with a maximum proppant concentration during the tail-in stage of 1000 kgPA (kilograms of proppant per cubic meter added), and a total mass of injected proppants of 8 metric tons (Table 1).

TABLE 1

Proppant concentrations and total masses for three fracturing design variants.

| Case | Max proppant concentration, kgPA | Total proppant mass, tons |
|---|---|---|
| Base case | 1000 | 8 |
| Low proppant concentration | 800 | 8 |
| Low concentration & mass | 800 | 6 |

Figure 9:
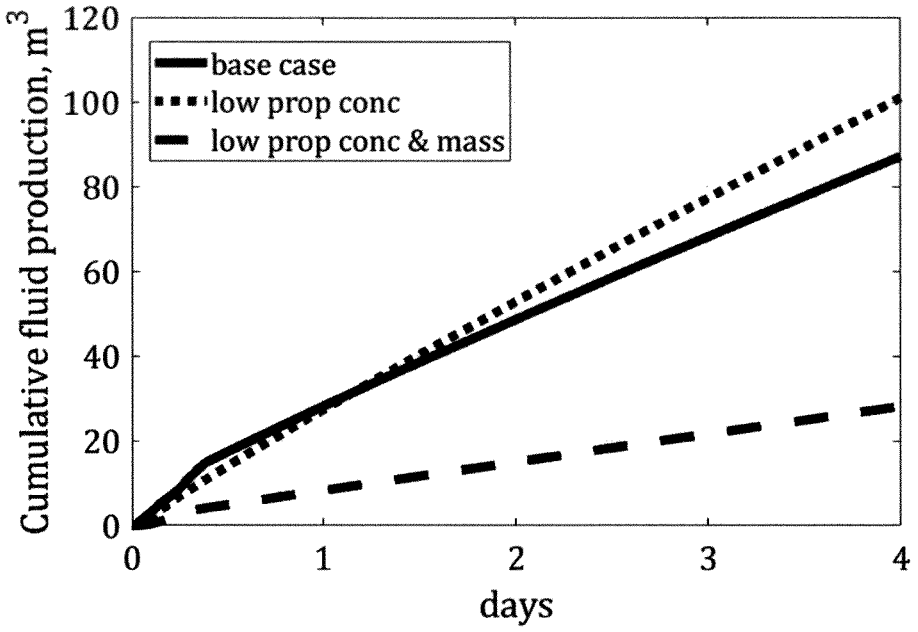
FIG. 9 shows cumulative fluid production from three fracture designs according to Example 2.
Figure 10:
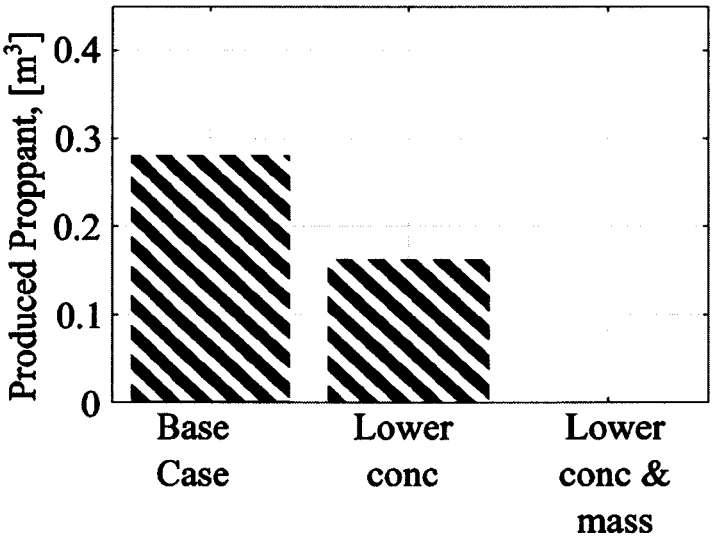
FIG. 10 shows the total volume of proppant produced from three fracture designs according to Example 2.

In this case, the flowback simulation for the given fracture design demonstrates a significant amount of proppant produced (0.28 m$^3$) and moderate production rate (FIGS. 9 and 10). If such a large amount of produced proppant exceeds the maximum tolerable proppant flowback volume from that well, optimization of the fracturing treatment is needed.

The second case (Low proppant concentration) exhibits reduction of proppant concentration from 1000 kgPA down to 800 kgPA, keeping the same amount of injected proppants into the fracture. Flowback simulation for the second variant shows that the amount of produced proppant is reduced by two times with respect to the base case. At the same time, the production rate is higher than that in the base case at the end of the first day. The production increase from the fracture is associated with reduced proppant losses, which preserves the original fracture conductivity. This case may be sufficient, but further refinement may be useful.

In the third case (Low proppant concentration & mass), the low concentration of proppant at tail-in stage is maintained, while the total mass of injected proppant has been reduced from 8 to 6 tons (see Table 1). This fracturing design completely prevents proppant flowback from the fracture (FIG. 10), but it results in a reduced fluid production rate from the fracture (FIG. 9). The reduced fracture conductivity occurs because of the reduced mass of proppant injected into the fracture.

Thus, the optimization procedure indicated that the second case offered the most productive fracture and reduced proppant flowback at the same time.

Example 3

Optimization of Flowback Schedule for Mitigation of Proppant Flowback and Improvement of Well Productivity This example provides an optimization workflow similar to the one in Example 2 but, instead of changes in the fracturing treatment design, the schedule of pressure drawdown during flowback is modified.

Figure 11:
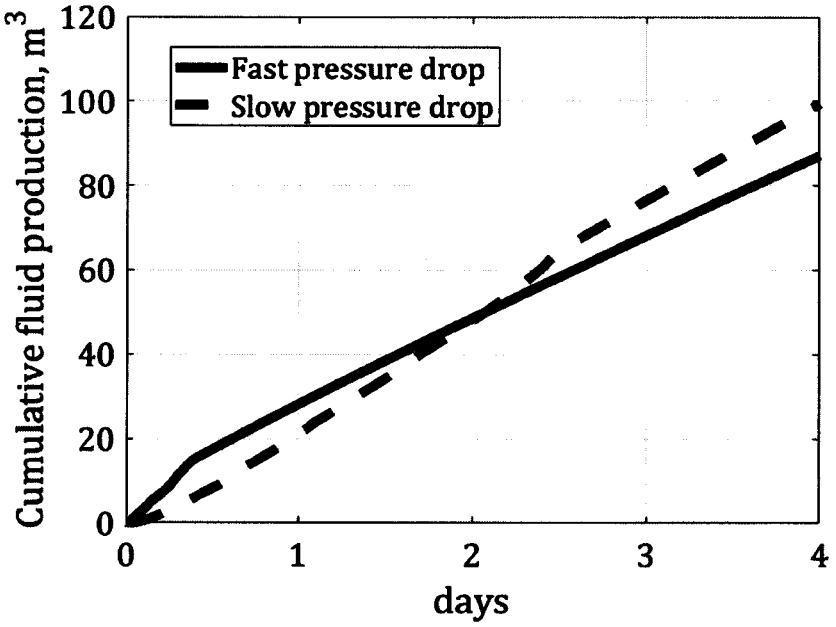
FIG. 11 shows cumulative fluid production from a fracture resulting from a fast pressure drawdown during the first 6 hours of flowback, and slow pressure drawdown during 60 hours of flowback.
Figure 12:
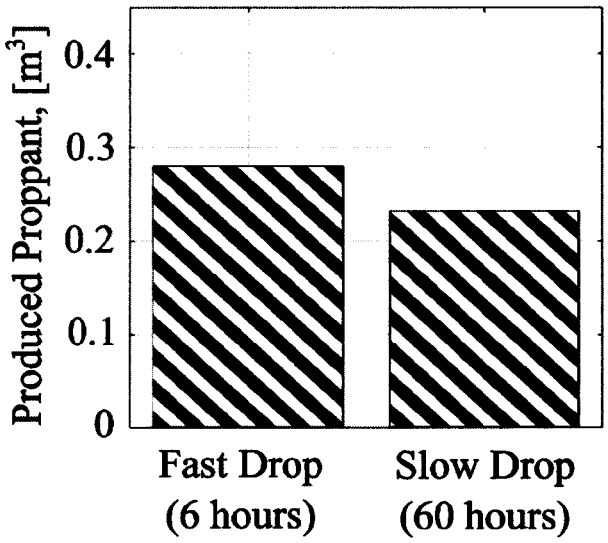
FIG. 12 shows the total volume of proppant flowback from a fracture during fast and slow pressure drawdown.

First, as a base case, the pressure drawdown from the reservoir is 20 bar during the first 6 hours of flowback. After 6 hours, the bottomhole pressure remains constant. In simulations, fluid production during the first 4 days of flowback may be sufficient but, unfortunately, it is accompanied by significant proppant flowback from the fracture (0.28 $m^3$) (FIGS. 11 and 12). Thus, the flowback schedule required revisiting.

In a second case the same fracturing design was considered, but the 20-bar pressure drop was extended to 60 hours. Such a slow pressure drop resulted in a lowered production rate during the first 60 hours of flowback; however, more proppant remained inside the fracture. The volume of produced proppants in the second case was reduced (FIG. 12). Moreover, in the second case, the production rate increased by the end of the second day. This is a consequence of the reduced proppant flowback and preserved fracture conductivity.

Example 4

Optimization of Operation and Fracture Parameters for Mitigation of Proppant Flowback This example demonstrates that proppant flowback may be optimized by using the model of critical filtration velocity, $u_c$. The example shows that the total volume of proppant produced from a well during the pressure drawdown can be either increased or decreased by varying a number of parameters such as fracture width w, mean proppant diameter d, fracturing fluid viscosity μ, pressure drop dp and the time of pressure drop $t_{drop}$.

TABLE 2

Parameters assumed for proppant flowback volume evaluation.

| Parameter | Value |
|---|---|
| Fracture surface, $m^2$ | 7800 |
| Fracture width w, mm | 10 |
| Proppant pack permeability k, D | 10 |
| Fracturing fluid viscosity μ, cP | 1 |
| Reservoir compressibility C, $Pa^{-1}$ | $10^{-10}$ |
| Reservoir porosity φ, dimensionless | 0.1 |
| Reservoir permeability $k_{res}$, D | 0.1 |
| Reservoir pressure, bar | 90 |
| Mean proppant size d, mm | 0.74 |

TABLE 3

Parametric study for proppant flowback model.

| Scenario | w, mm | d, mm | w/d,- | μ, cP | dp, bar | $t_{drop}$, h | $V_s$, $m^3$ |
|---|---|---|---|---|---|---|---|
| 1 | 10 | 0.74 | 13.5 | 1 | 30 | 2 | 0.53 |
| 2 | 5 | 0.74 | 6.8 | 1 | 30 | 2 | 0.0057 |
| 3 | 15 | 0.74 | 20.3 | 1 | 30 | 2 | 4.8 |
| 4 | 10 | 1.5 | 6.7 | 1 | 30 | 2 | 0.2 |

TABLE 3-continued

Parametric study for proppant flowback model.

| Scenario | w, mm | d, mm | w/d,- | μ, cP | dp, bar | $t_{drop}$, h | $V_s$, $m^3$ |
|---|---|---|---|---|---|---|---|
| 5 | 10 | 0.3 | 33.3 | 1 | 30 | 2 | 0.99 |
| 6 | 10 | 0.74 | 13.5 | 10 | 30 | 2 | 0.82 |
| 7 | 10 | 0.74 | 13.5 | 100 | 30 | 2 | 0.99 |
| 8 | 10 | 0.74 | 13.5 | 1 | 40 | 2 | 1.81 |
| 9 | 10 | 0.74 | 13.5 | 1 | 20 | 2 | 0.08 |
| 10 | 10 | 0.74 | 13.5 | 1 | 30 | 6 | 0.5 |
| 11 | 10 | 0.74 | 13.5 | 1 | 30 | 0.5 | 0.55 |

First, the width of the propped fracture w was changed in a manner that was proportional to the total mass of proppant injected into the fracture. Three values of fracture width w were selected: 5, 10.15 mm (Scenarios 1-3). The amounts of produced proppant in these three scenarious were 0.0057, 0.53 and 4.8 $m^3$, respectively. Therefore, wide fractures may be undesirable in the context of proppant flowback.

In a second series of fracture parameter changes, the mean grain size of a proppant d was modified in the range d=0.3, 0.74 and 1.5 mm (Scenarios 1, 4 and 5). The corresponding volumes of proppant flowback were: 0.99, 0.53 and 0.2 $m^3$, respectively. Therefore, for solids production mitigation, larger proppant sizes may be preferred.

As a third parameter, the viscosity of produced fracturing fluid was varied: μ (1, 10, 100 cP) (Scenarios 1, 6 and 7). For these three types of fluids, the proppant production was 0.53, 0.82, 0.99 $m^3$, respectfully. Thus, there is a direct correlation between fluid viscosity and proppant production.

A fourth parameter that affects proppant flowback is pressure drop (dp). Three values were used to compare dp (20, 30 and 40 bar) (Scenarios 1, 8 and 9). The amount of proppant produced was 0.08, 0.53, 1.81 $m^3$, respectively. Thus, reducing the pressure cautiously may prevent high proppant volumes produced back into a well.

A fifth parameter chosen for this study was the time of pressure drop ($t_{drop}$). For pressure drop times 0.5, 3 and 6 h (Scenarios 1, 10 and 11), the produced proppant volumes were 0.5, 0.53 and 0.55 $m^3$, respectively. The difference may seem insignificant; however, if the pressure drawdown continues for days rather than several hours, the cumulative proppant production may reach undesirable level.

Example 5

Example of Workflow 1 with Several Iterations to Reduce Proppant Flowback Volume This example provides an example of implementation of Workflow 1 (FIG. 1). Following this workflow, one wants to identify parameters of hydraulic fracturing and flowback designs to achieve proppant flowback volume $V_s$ below $V_c$=0.5 $m^3$. The Scenario 8 (see Table 3) is considered as a base case. The flowback simulation for the base case demonstrates 1.81 $m^3$ of proppant flowback which is above $V_c$.

According to the Workflow 1 on the second iteration one may change parameter of flowback design. Reducing pressure drop dp from 40 bar (Scenario 8, Table 3) down to 30 bar (Scenario 1, Table 3) lead to decreasing to proppant flowback volume down to 0.53 $m^3$. This volume is still above target $V_c$.

On the second iteration of the Workflow 1, one modifies the hydraulic fracturing design by increasing proppant diameter from 0.74 mm (Scenario 1, Table 3) up to 1.5 mm (Scenario 4, Table 3). Hydraulic fracturing and flowback simulations demonstrate 0.2 $m^3$ of proppant flowback. This value satisfies condition $V_s<V_c$, hence Scenario 4 should be used for hydraulic fracturing and flowback jobs.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

The invention claimed is:

1. A method for fracturing a subterranean well, the method comprising:

(i) designing a fracturing treatment for stimulating a reservoir, the fracturing treatment comprising creating a fracture, design parameters for the fracturing treatment comprising at least one of: proppant concentration, fluid viscosity, flow rate, job stages, final fracture geometry, or one or more combinations thereof;

(ii) performing a computer simulation of the fracturing treatment, wherein the performing comprises generating a prediction of at least one of: fracture propagation, proppant distribution, fluid distribution, or fracture conductivity distribution;

(iii) setting flowback design parameters comprising bottomhole or wellhead pressure, flowback time, and flowback duration;

(iv) determining a critical filtration velocity $u_c$ for each computation cell for a final fracture geometry;

(v) determining a fluid production flow rate and a proppant flowback volume for specified flowback conditions; and (vi) computing a recovered proppant volume $V_s$ and fluid production $Q_f$ at a near-wellbore boundary by repeating stages (iv) and (v) for consecutive intervals of flowback duration; and one of:

(vii) responsive to $V_s<V_c$ and $Q_f>Q_{min}$, performing the designed fracturing treatment, where $Q_{min}$ is a minimum acceptable fluid production rate and $V_c$ is a maximum acceptable proppant flowback volume; or (viii) responsive to $V_s$ or $Q_f$ not satisfying conditions stated in stage (vii), repeating stages (i)-(vi) with adjusted fracturing design parameters.

2. The method of claim 1, wherein the critical filtration velocity $u_c$ depends on parameters comprising at least one of: wall stress, effective proppant diameter, fracture width, fluid viscosity, proppant embedment, or one or more combinations thereof.

3. The method of claim 1, wherein, during computer simulations, predicted proppant flow velocities slower than the critical filtration velocity $u_c$ indicate zero proppant mobility in the fracture.

4. The method of claim 1, wherein the computing the recovered proppant volume $V_s$ is performed using parameters comprising at least one of: fracture surface area, fracture width, proppant pack permeability, fluid viscosity, reservoir compressibility, reservoir porosity, reservoir pressure, effective proppant size, or one or more combinations thereof.

5. The method of claim 1, wherein stage (i) further comprises obtaining mechanical and conductive properties of the reservoir, well trajectory, and placement of casing perforations.

6. The method of claim 1, wherein stage (i) further comprises collecting laboratory data corresponding to fluid properties and proppant properties.

7. The method of claim 1, wherein stage (i) further comprises selecting a hydraulic fracturing schedule.

8. A method for fracturing a subterranean well, the method comprising:

(i) obtaining a design for a previously-performed fracturing treatment for stimulating a reservoir;

(ii) performing a computer simulation of the fracturing treatment, the performing comprising generating a prediction of at least one of: fracture propagation, proppant distribution, fluid distribution, and fracture conductivity distribution;

(iii) setting flowback job design parameters comprising bottomhole or wellhead pressure, flowback time, and flowback duration;

(iv) determining a critical filtration velocity $u_c$ for each computation cell for a final fracture geometry;

(v) determining a fluid production flow rate and a proppant flowback volume; and (vi) computing a recovered proppant volume $V_s$ and fluid production $Q_f$ at a near-wellbore boundary by repeating stages (iv) and (v) for consecutive intervals of flowback duration; and one of:

(vii) responsive to $V_s<V_c$ and $Q_f>Q_{min}$, performing the flowback job as designed, where $Q_{min}$ is a minimum acceptable fluid production rate and $V_c$ is a maximum acceptable proppant flowback volume; or (viii) responsive to $V_s$ or $Q_f$ not satisfying conditions stated in stage (vii), repeating stages (iii)-(vi) with adjusted flowback job design parameters.

9. The method of claim 8, wherein the design parameters from the previously-performed fracturing treatment comprise at least one of: proppant concentration, fluid viscosity, flow rate, job stages, fracture geometry, or one or more combinations thereof.

10. The method of claim 8, wherein the critical filtration velocity $u_c$ depends on parameters comprising at least one of: wall stress, effective proppant diameter, fracture width, fluid viscosity and proppant embedment, or one or more combinations thereof.

11. The method of claim 8, wherein, during computer simulations, predicted proppant flow velocities slower than the critical filtration velocity $u_c$ indicate zero proppant mobility in a fracture.

12. The method of claim 8, wherein the computing the recovered proppant volume $V_s$ is performed using parameters comprising at least one of: fracture surface area, fracture width, proppant pack permeability, fluid viscosity, reservoir compressibility, reservoir porosity, reservoir pressure, mean proppant size, or one or more combinations thereof.

* * * * *